US011078922B2

(12) United States Patent
Iwakiri et al.

(10) Patent No.: US 11,078,922 B2
(45) Date of Patent: Aug. 3, 2021

(54) SCROLL CASING AND CENTRIFUGAL COMPRESSOR

(71) Applicant: MITSUBISHI HEAVY INDUSTRIES ENGINE & TURBOCHARGER, LTD., Sagamihara (JP)

(72) Inventors: Kenichiro Iwakiri, Tokyo (JP); Isao Tomita, Tokyo (JP); Takashi Shiraishi, Tokyo (JP)

(73) Assignee: MITSUBISHI HEAVY INDUSTRIES ENGINE & TURBOCHARGER, LTD., Sagamihara (JP)

( * ) Notice: Subject to any disclaimer, the term of this patent is extended or adjusted under 35 U.S.C. 154(b) by 400 days.

(21) Appl. No.: 15/578,047

(22) PCT Filed: Oct. 29, 2015

(86) PCT No.: PCT/JP2015/080494
§ 371 (c)(1),
(2) Date: Nov. 29, 2017

(87) PCT Pub. No.: WO2017/072900
PCT Pub. Date: May 4, 2017

(65) Prior Publication Data

US 2018/0149170 A1 May 31, 2018

(51) Int. Cl.
*F04D 29/42* (2006.01)
*F04D 29/44* (2006.01)
(Continued)

(52) U.S. Cl.
CPC ..... *F04D 29/4206* (2013.01); *F04D 29/422* (2013.01); *F04D 29/44* (2013.01);
(Continued)

(58) Field of Classification Search
None
See application file for complete search history.

(56) References Cited

U.S. PATENT DOCUMENTS 3,289,921 A * 12/1966 Soo ..... F04D 29/441 415/207
3,489,340 A 1/1970 Holzhausen
(Continued)

FOREIGN PATENT DOCUMENTS

CN 101421520 A 4/2009
CN 101737359 A 6/2010
(Continued)

OTHER PUBLICATIONS

Extended European Search Report effective Apr. 30, 2018 issued to the corresponding EP Application No. 15907264.4.
(Continued)

*Primary Examiner* — Ninh H. Nguyen
*Assistant Examiner* — Jason Fountain
(74) *Attorney, Agent, or Firm* — Birch, Stewart, Kolasch & Birch, LLP

(57) ABSTRACT

A scroll casing forms a scroll flow passage of a centrifugal compressor, and provided that, in a cross section of the scroll flow passage, Ei is an inner end of the scroll flow passage in a radial direction of the centrifugal compressor, and Mh is a middle point of a maximum flow-passage height Hmax of the scroll flow passage in the axial direction of the centrifugal compressor, the scroll flow passage has a separation suppressing cross section in which the inner end Ei is disposed on an inner side, in the radial direction, of a diffuser outlet, and the inner end Ei is disposed on a back side, in the axial direction, of the middle point Mh, in a section disposed at least partially in an upstream region of a connection position of a scroll start and a scroll end.

9 Claims, 10 Drawing Sheets

(51) Int. Cl.
*F04D 29/66* (2006.01)
*F04D 17/10* (2006.01)
*F04D 29/28* (2006.01)

(52) U.S. Cl.
CPC ..... *F04D 29/441* (2013.01); *F04D 29/667* (2013.01); *F04D 17/10* (2013.01); *F04D 29/284* (2013.01)

(56) References Cited

U.S. PATENT DOCUMENTS

| | | | | |
|---|---|---|---|---|
| 5,143,514 | A | 9/1992 | Adachi | |
| 9,366,265 | B2 * | 6/2016 | Tomita | F04D 29/441 |
| 9,435,346 | B2 * | 9/2016 | Osuka | F04D 29/023 |
| 10,066,638 | B2 * | 9/2018 | Bessho | F02B 33/40 |
| 2007/0113551 | A1 | 5/2007 | Arnold et al. | |
| 2012/0321440 | A1 | 12/2012 | Zheng et al. | |
| 2013/0039750 | A1 * | 2/2013 | Osuka | F04D 29/4206 415/204 |
| 2013/0266432 | A1 | 10/2013 | Iwakiri et al. | |
| 2013/0294903 | A1 * | 11/2013 | Tomita | F04D 29/441 415/204 |
| 2014/0105736 | A1 | 4/2014 | Kiriaki | |
| 2016/0076553 | A1 | 3/2016 | Bessho | |

FOREIGN PATENT DOCUMENTS

| | | | |
|---|---|---|---|
| EP | 0138480 | A2 | 4/1985 |
| GB | 1153345 | A | 5/1969 |
| JP | 60-81498 | A | 5/1985 |
| JP | 4492045 | B2 | 1/2005 |
| JP | 2011-231620 | A | 11/2011 |
| JP | 5479316 | B2 | 7/2012 |
| JP | 2013-19385 | A | 1/2013 |
| WO | WO 2015/019901 | A1 | 5/1969 |
| WO | WO 2012/090649 | A1 | 7/2012 |

OTHER PUBLICATIONS

Chinese Office Action and Search Report, dated Jan. 2, 2019, for Chinese Application No. 201580080331.3, with an English machine translation of the Chinese Office Action.
Office Action dated Nov. 10, 2020 issued in counterpart European Application No. 15907264.4.

* cited by examiner

SCROLL CASING AND CENTRIFUGAL COMPRESSOR

TECHNICAL FIELD

The present disclosure relates to a scroll casing and a centrifugal compressor.

BACKGROUND ART

The centrifugal compressor used in a compressor part or the like of a turbocharger for an automobile or a ship imparts kinetic energy to a fluid through rotation of an impeller and discharges the fluid outward in the radial direction, thereby achieving a pressure increase by utilizing the centrifugal force.

Such a centrifugal compressor is provided with various features to meet the need to improve the pressure ratio and the efficiency in a broad operational range.

In typical art, for instance, Patent Document 1 discloses a centrifugal compressor provided with a casing having a scroll flow passage formed to have a spiral shape, wherein the height of the scroll flow passage in the axial direction increases gradually from inside toward outside in the radial direction, and reaches its maximum on the radially outer side of the middle point of the flow passage width with respect to the radial direction.

CITATION LIST

Patent Literature

Patent Document 1: JP4492045B

SUMMARY

Problems to be Solved

FIG. 12 is a schematic diagram of a scroll flow passage 004 in the axial directional view of the centrifugal compressor according to a comparative example. FIG. 13 is a diagram of the scroll flow passage of the centrifugal compressor shown in FIG. 12, showing a cross-sectional shape of the flow passage overlapping at each predetermined angle $\Delta\theta$ from the connection position (tongue section position) P of a scroll start 004*a* and a scroll end 004*b* toward the downstream side (scroll start side). The cross-sectional shape of the scroll flow passage in the centrifugal compressor is generally formed in a circular shape over the entire periphery of the scroll flow passage as shown in FIG. 13.

At the small flow-rate operation point of the centrifugal compressor, the flow inside the scroll flow passage becomes a speed reduction flow from the scroll start to the scroll end of the scroll flow passage, and the pressure at the scroll start is lower than the pressure at the scroll end. Thus, in the scroll flow passage, a recirculation flow fc from the scroll end to the scroll start is generated at the tongue section position P (see FIG. 12). Such a recirculation flow causes separation as a result of the main flow being drawn into a flow-passage connection part rapidly, which is one of the main causes of generation of high loss.

Although Patent Document 1 discloses a technique to improve the characteristics of the swirl flow in the scroll flow passage by forming the scroll flow passage to have a special non-circular shape in cross section, it does not disclose an approach for suppressing a recirculation flow in the vicinity of the tongue section.

The present invention was made in view of the above, and an object of the present invention is to provide a scroll casing capable of improving the compressor performance by reducing the loss that accompanies the recirculation flow, and a centrifugal compressor having the same.

Solution to the Problems (1) A scroll casing according to at least one embodiment of the present invention is a scroll casing which forms a scroll flow passage of a centrifugal compressor, and provided that, in a cross section of the scroll flow passage, Ei is an inner end of the scroll flow passage in a radial direction of the centrifugal compressor, and Mh is a middle point of a maximum flow-passage height Hmax of the scroll flow passage in the axial direction of the centrifugal compressor, the scroll flow passage has a separation suppressing cross section in which the inner end Ei is disposed on an inner side, in the radial direction, of a diffuser outlet, and the inner end Ei is disposed on a back side, in the axial direction, of the middle point Mh, in a section disposed at least partially in an upstream region of a connection position of a scroll start and a scroll end.

With the above scroll casing (1), it is possible to form the scroll flow passage so that the flow line curvature of the fluid that becomes the recirculation flow gradually (smoothly) changes toward the connection position, compared to the comparative example (where the scroll flow passage has a circular cross-sectional shape over the entire region in the circumferential direction, where the axial directional position of the inner end Ei and the axial directional position of the middle point Mh coincide with each other). Accordingly, it is possible to suppress a rapid change in the flow line curvature of the fluid that becomes the recirculation flow in the vicinity of the connection position, which makes it possible to suppress separation due to the rapid change, and to reduce loss that accompanies recirculation.

(2) In some embodiments, in the scroll casing described in the above (1), provided that an angular position about a scroll center of the scroll flow passage is zero degree at the connection position and the angular position is $\theta$ at a position upstream of the connection position, the separation suppressing cross section may be disposed at least in a section from $\theta$=zero degree to a predetermined angular position.

With the above scroll casing (2), the separation suppressing cross section is disposed from the connection position in the scroll flow passage to an upstream predetermined angular position, and thereby it is possible to form the scroll flow passage so that the flow line curvature of the fluid that becomes the recirculation flow changes gradually (smoothly) from the angular position to the connection position. Accordingly, it is possible to suppress a rapid change in the flow line curvature of the fluid that becomes the recirculation flow in the vicinity of the connection position, which makes it possible to suppress separation due to the rapid change, and to reduce loss that accompanies recirculation.

(3) In some embodiments, in the scroll casing described in the above (2), the predetermined angular position may be an angular position of not less than 60 degrees.

With the above scroll casing (3), it is possible to form the scroll flow passage so that the flow line curvature of the fluid that becomes a recirculation flow changes gradually toward the connection position in the section from the connection position to a predetermined angular position of 60 degrees or more. Accordingly, it is possible to suppress a rapid change in the flow line curvature of the recirculation flow in the vicinity of the connection position, which makes it possible to suppress separation due to the rapid change, and to reduce loss that accompanies recirculation.

(4) In some embodiments, in the scroll casing described in any one of the above (1) to (3), the separation suppressing cross section is not disposed in a section upstream of the predetermined angular position.

The cross-sectional shape at the position separated upstream to some extent from the connection position in the scroll flow passage has a small effect on separation generation in the vicinity of the connection position, and thus the separation suppressing cross section may not be necessarily formed in the upstream section of the predetermined angular position separated to some extent from the connection position, as in the above (4). In this case, for the section upstream of the predetermined angular section, the cross-sectional shape may be designed in priority of other purposes. For instance, a circular cross-sectional shape may be applied in order to reduce flow loss in the scroll flow passage.

(5) In some embodiments, in the scroll casing described in the above (4), the predetermined angular position is an angular position of not less than 60 degrees and not more than 150 degrees.

With the above scroll casing (5), the scroll flow passage is formed so that the flow line curvature of the fluid that becomes a recirculation flow changes gradually toward the connection position to the predetermined angular position of not less than 60 degrees and not more than 150 degrees, and for the section upstream of the predetermined angular section, the cross-sectional shape may be designed in priority of other purposes. For instance, a circular cross-sectional shape may be applied in order to reduce flow loss in the scroll flow passage.

(6) In some embodiments, in the scroll casing according to any one of the above (2) to (5), the scroll flow passage includes a section having a circular cross section at a downstream side of the predetermined angular position.

With the above scroll casing (6), with the separation suppressing cross section applied to the section in the vicinity of the connection position for separation suppression and a circular cross sectional shape or the like applied to the section separated to some extent from the connection position, it is possible to reduce flow loss in the scroll flow passage while suppressing separation in the vicinity of the connection position.

(7) In some embodiments, in the scroll casing described in any one of the above (2) to (6), at least in a part of the section of the scroll flow passage from θ=zero degree to the predetermined angular position, the inner end Ei of the separation suppressing cross section may be shifted backward in the axial direction with a distance from an upstream side toward the connection position.

With the above scroll casing (7), it is possible to form the scroll flow passage so that the flow line curvature of the fluid that becomes the recirculation flow gradually (smoothly) changes toward the connection position, compared to the comparative example (where the scroll flow passage has a circular cross-sectional shape over the entire region in the circumferential direction, where the axial directional position of the inner end Ei and the axial directional position of the middle point Mh coincide with each other). Accordingly, it is possible to suppress a rapid change in the flow line curvature of the fluid that becomes the recirculation flow in the vicinity of the connection position, which makes it possible to suppress separation due to the rapid change, and to reduce loss that accompanies recirculation.

(8) In some embodiments, in the scroll casing according to any one of the above (2) to (7), at least in a part of the section of the scroll flow passage from θ=zero degree to the predetermined angular position, a flow-passage wall portion connecting the inner end Ei and the front end Ef of the scroll flow passage with respect to the axial direction has a curved surface portion which protrudes toward a cross-sectional center of the separation suppressing surface.

With the scroll casing (8), in the separation suppressing cross section, it is possible to separate the region through which the main flow passes toward the outlet of the scroll flow passage from the region through which the fluid that becomes the recirculation flow passes to some extent, with the curved surface portion protruding toward the cross-sectional center. Thus, it is possible to guide the main flow to the outlet of the scroll flow passage smoothly and to guide the fluid that becomes the recirculation flow to the connection position smoothly, thereby reducing the pressure loss effectively.

(9) In some embodiments, in the scroll casing described in the above (8), the curved surface portion is formed so as to have a curvature radius which decreases from an upstream side of the scroll flow passage toward the connection position.

With the above scroll casing (9), it is possible to separate the main flow and the recirculation flow gradually (smoothly) from the upstream of the scroll flow passage toward the connection position, and thus it is possible to enhance the effect of the above (8) to guide the main flow to the outlet of the scroll flow passage smoothly and to guide the fluid that becomes the recirculation flow to the connection position smoothly, thereby reducing pressure loss effectively.

(10) In some embodiments, in the scroll casing described in any one of the above (1) to (7), in the cross section of the scroll flow passage, in a case where Lz is a line passing through a middle point Mw of a maximum flow-passage width Wmax of the scroll flow passage in the radial direction and parallel to the axial direction, Lr is a line passing through the middle point Mh and parallel to the radial direction, and the separation suppressing cross section is divided into four regions by the line Lz and the line Lr, a flow-passage wall portion belonging to a region positioned on an outer side in the radial direction and on a front side in the axial direction of an intersection C of the line Lz and the line Lr, of the four regions, includes an arc portion having a first curvature radius R1, a flow-passage wall portion belonging to a region positioned on an inner side in the radial direction and on a front side in the axial direction of the intersection C, of the four regions, includes an arc portion having a second curvature radius R2 which is greater than the first curvature radius R1, and a flow-passage wall portion belonging to a region positioned on an inner side in the radial direction and on a back side in the axial direction of the intersection C, of the four regions, includes an arc portion having a third curvature radius R3 which is smaller than the second curvature radius R2.

With the above scroll casing (10), when compared to a comparative example (where the scroll flow passage has a circular cross sectional shape over the entire region in the circumferential direction), the curvature radius R2 of the arc portion belonging to the region positioned on the inner side in the radial direction and on the front side in the axial direction of the intersection C, of the four regions, is greater than each of the curvature radius R1 and the curvature radius R2 belonging to other regions, and thus it is easier to position the inner end Ei on the back side in the axial direction without changing the flow passage cross-sectional area. Thus, it is possible to form the scroll flow passage easily so that the flow line curvature of the fluid that becomes a recirculation flow changes gradually (smoothly) toward the connection position. Accordingly, it is possible to suppress a rapid change in the flow line curvature of the fluid that becomes the recirculation flow in the vicinity of the connection position, which makes it possible to suppress separation due to the rapid change, and to reduce loss that accompanies recirculation.

(11) In some embodiments, in the scroll casing described in any one of the above (1) to (10), at least in a part of the section of the scroll flow passage from θ=zero degree to the predetermined angular position, the maximum flow-passage height Hmax and a distance Δz between the inner end Ei of the separation suppressing cross section and the middle point Mh in the axial direction satisfies $\Delta z \geq 0.1 \times Hmax$.

With the above scroll casing (11), it is possible to effectively suppress separation due to a rapid change in the flow line curvature of the fluid that becomes a recirculation flow in the vicinity of the connection position P.

(12) In some embodiments, in the scroll casing described in any one of the above (2) to (11), the scroll flow passage is formed so that the inner end Ei is shifted forward in the axial direction with a distance from the connection position toward an outlet of the scroll flow passage.

With the above scroll casing (11), It is possible to form the scroll flow passage so that the separation suppressing cross section gradually returns to a circular cross section toward the outlet of the scroll flow passage from the connection position. Accordingly, it is possible to suppress occurrence of separation that accompanies a recirculation flow in the vicinity of the connection position P while reducing flow loss at the downstream side of the connection position.

(13) A centrifugal compressor according to at least one embodiment of the present invention comprises: an impeller; and the scroll casing according to any one of the above (1) to (12), the scroll casing being disposed around the impeller and forming a scroll flow passage into which a fluid flows after passing through the impeller.

With the above centrifugal compressor (13), the scroll casing is the scroll casing described in any one of the above (1) to (12), and thus it is possible to suppress a rapid change in the flow line curvature of the fluid that becomes a recirculation flow in the vicinity of the connection position. Accordingly, it is possible to suppress separation due to the rapid change and to reduce loss that accompanies recirculation, thereby improving the performance (efficiency) of the centrifugal compressor.

Advantageous Effects

According to at least one embodiment of the present invention, provided is a scroll casing capable of improving the compressor performance by reducing the loss that accompanies the recirculation flow, and a centrifugal compressor having the same.

DETAILED DESCRIPTION

Embodiments of the present invention will now be described in detail with reference to the accompanying drawings. It is intended, however, that unless particularly specified, dimensions, materials, shapes, relative positions and the like of components described in the embodiments shall be interpreted as illustrative only and not intended to limit the scope of the present invention.

For instance, an expression of relative or absolute arrangement such as "in a direction", "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

For instance, an expression of an equal state such as "same" "equal" and "uniform" shall not be construed as indicating only the state in which the feature is strictly equal, but also includes a state in which there is a tolerance or a difference that can still achieve the same function.

Further, for instance, an expression of a shape such as a rectangular shape or a cylindrical shape shall not be construed as only the geometrically strict shape, but also includes a shape with unevenness or chamfered corners within the range in which the same effect can be achieved.

On the other hand, an expression such as "comprise", "include", "have", "contain" and "constitute" are not intended to be exclusive of other components.

Figure 1:
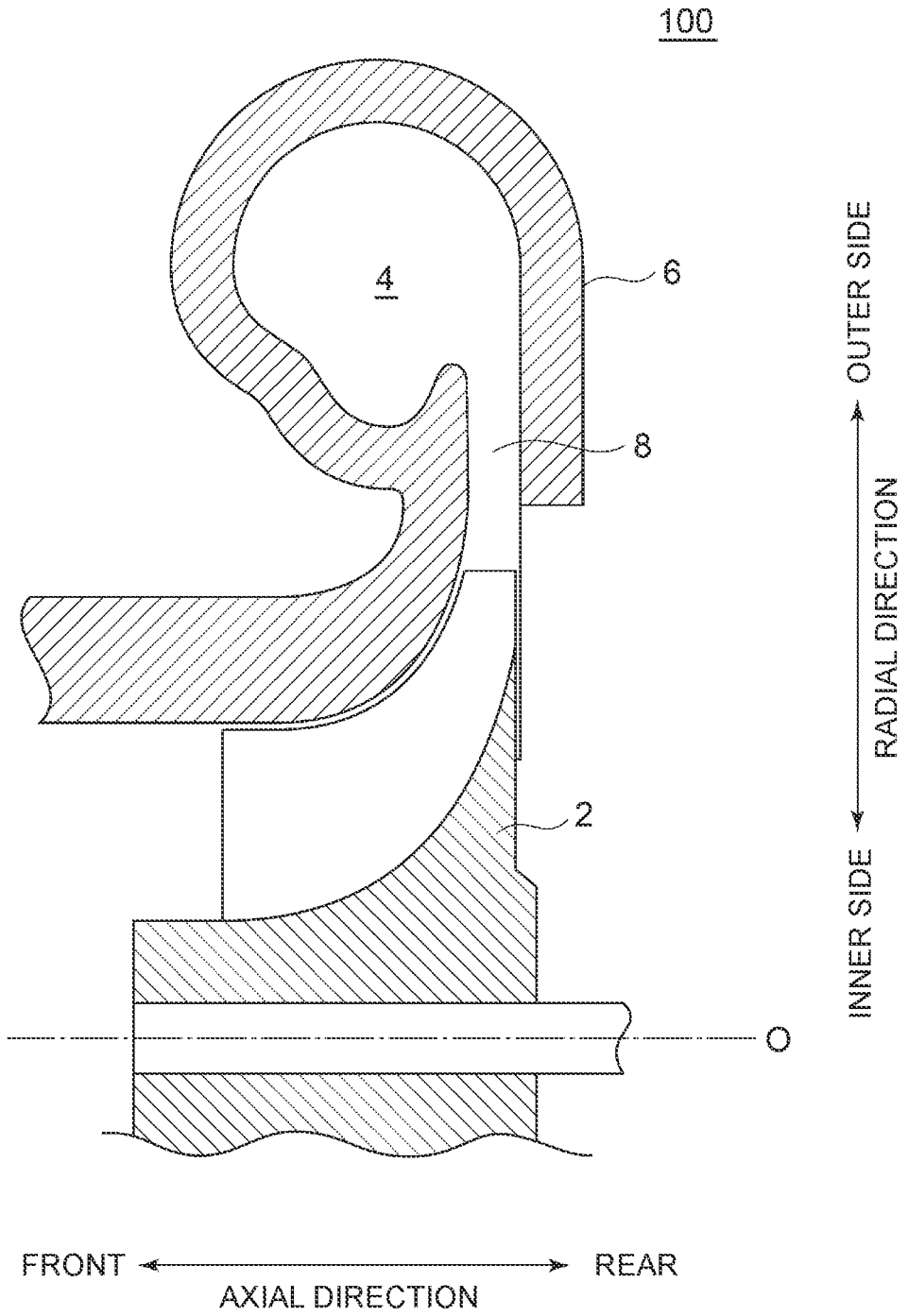
FIG. 1 is a schematic cross-sectional view of a centrifugal compressor 100 according to an embodiment, taken along the axial direction of the compressor 100.

FIG. 1 is a schematic cross-sectional view of a centrifugal compressor 100 according to an embodiment, taken along the axial direction of the compressor 100.

In the present specification, unless otherwise stated, "axial direction" refers to the axial direction of the centrifugal compressor 100, that is, the axial direction of the impeller 2, "front side" in the axial direction refers to the upstream side in the intake direction of the centrifugal compressor 100 with respect to the axial direction, and "back side" in the axial direction refers to the downstream side in the intake direction of the centrifugal compressor 100 with respect to the axial direction. Furthermore, unless otherwise stated, "radial direction" refers to the radial direction of the centrifugal compressor 100, that is, the radial direction of the impeller 2. The centrifugal compressor 100 can be applied to a turbocharger for an automobile or a ship, or other industrial centrifugal compressors and blowers, for instance.

As shown in FIG. 1, the centrifugal compressor 100 includes an impeller 2, and a scroll casing 6 disposed around the impeller 2, the scroll casing 6 forming a scroll flow passage 4 into which a fluid flows after passing through the impeller 2 and a diffuser flow portion 8.

Figure 2:
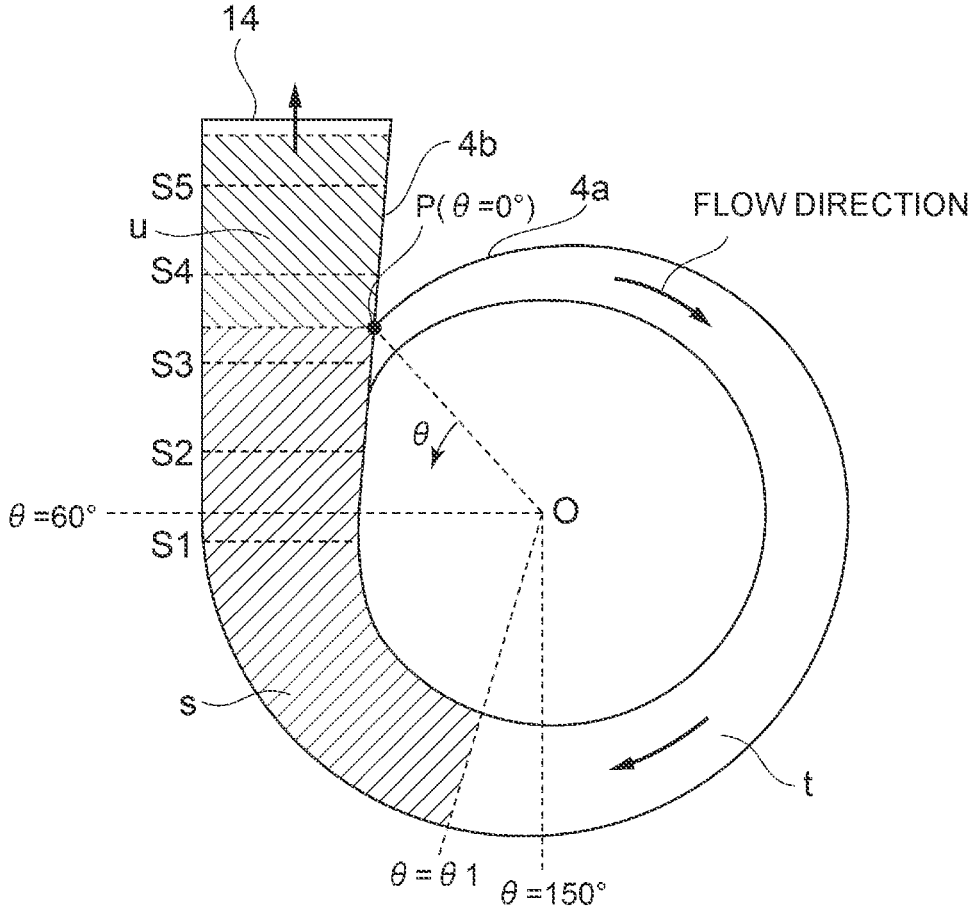
FIG. 2 is a schematic diagram of a scroll flow passage in the axial directional view of the centrifugal compressor 100 according to an embodiment.

FIG. 2 is a schematic diagram of a scroll flow passage 4 in the axial directional view of the centrifugal compressor 100 according to an embodiment.

In an embodiment, the scroll flow passage 4 may have a separation suppressing cross section 10 described below, in a section 's' disposed at least partially in a region upstream of the connection position (tongue section) P of the scroll start 4*a* and the scroll end 4*b*.

Figure 3:
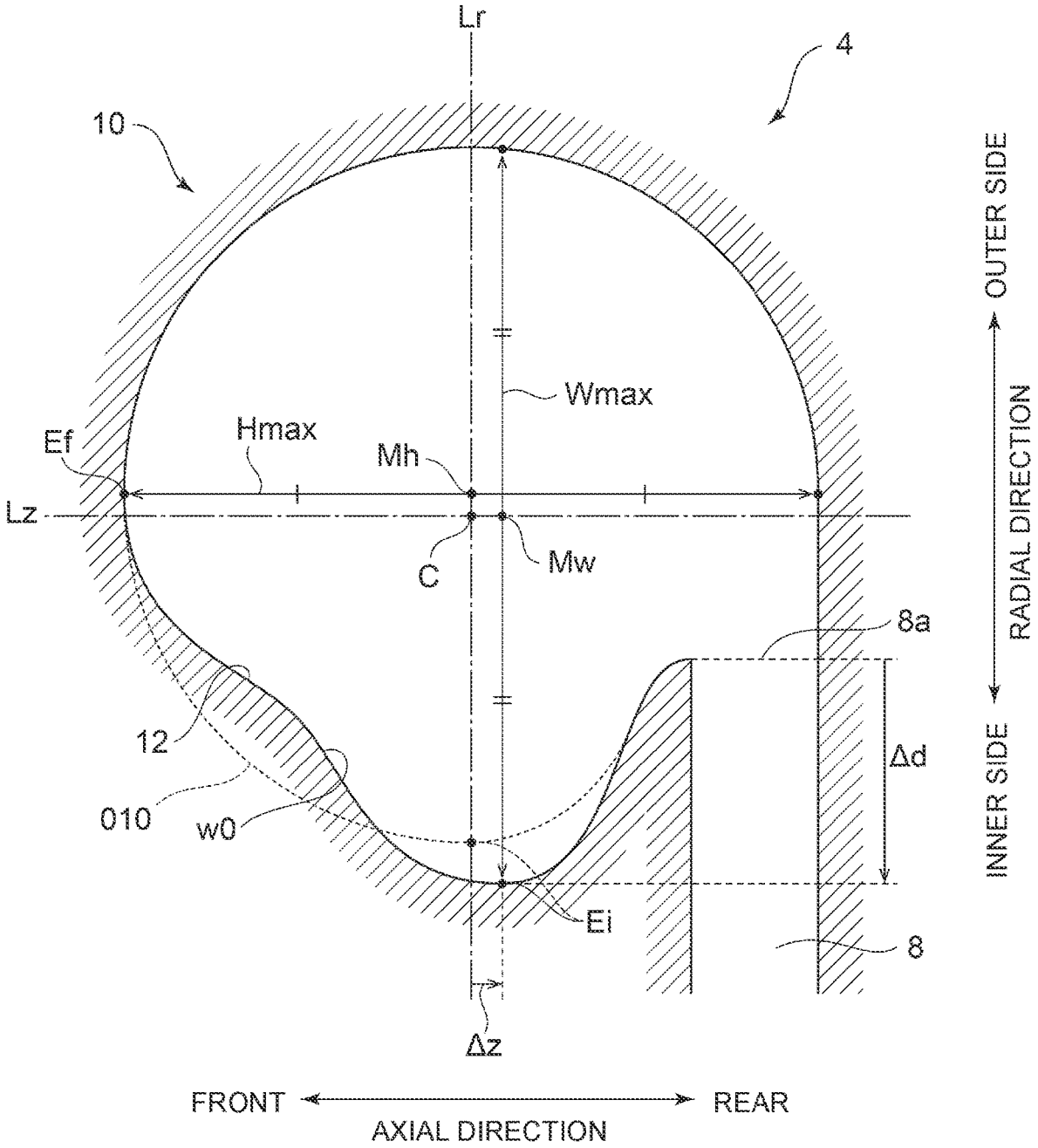
FIG. 3 is a schematic cross-sectional view for describing a shape of a separation suppressing cross section 10 according to an embodiment.
Figure 4:
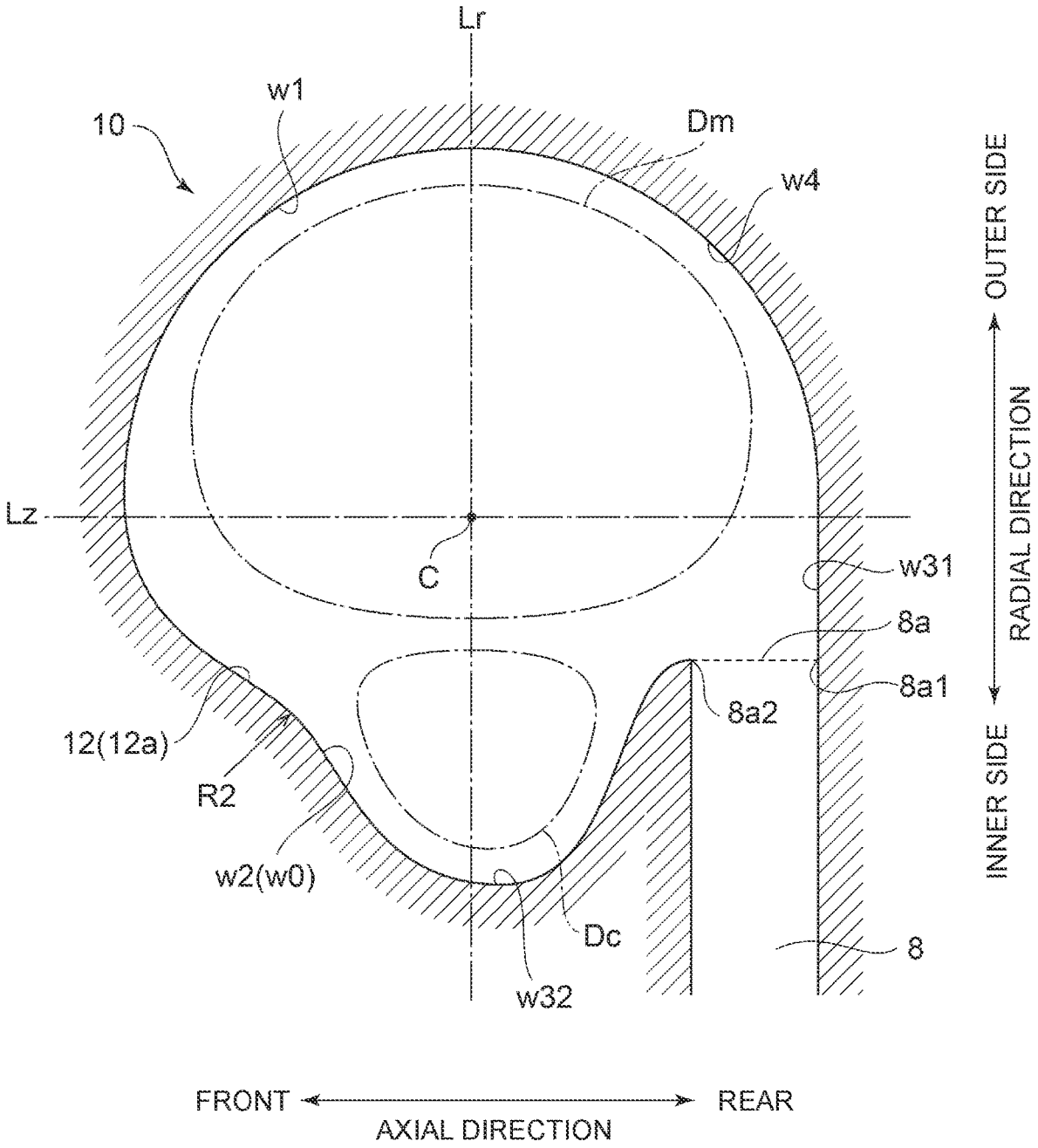
FIG. 4 is a schematic cross-sectional view for describing a shape of a separation suppressing cross section 10 according to an embodiment.
Figure 5:
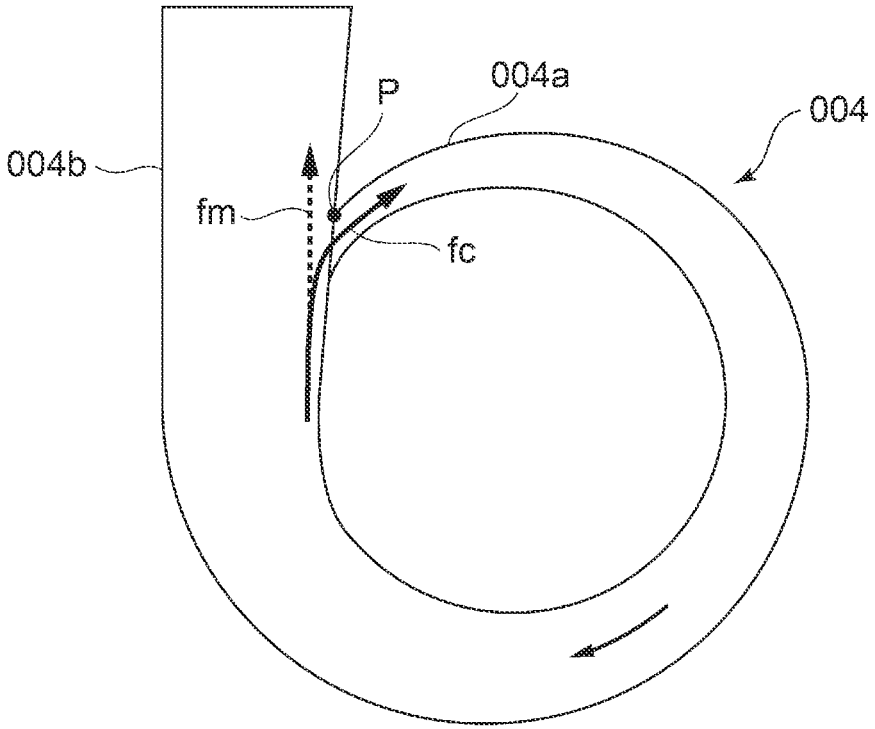
FIG. 5 is a diagram showing the flow line of the recirculation flow fc according to a comparative example (the scroll flow passage has a circular cross-sectional shape, through the entire region in the circumferential direction, where the axial directional position of the inner end Ei and the axial directional position of the middle point Mh coincide with each other).

FIGS. 3 and 4 are each a schematic cross-sectional view for describing a shape of a separation suppressing cross section 10 according to an embodiment.

In an embodiment, as shown in FIG. 3, in the cross section of the scroll flow passage 4, provided that Ei is the inner end of the scroll flow passage 4 in the radial direction, and Mh is the middle point of the maximum flow-passage height Hmax of the scroll flow passage 4 in the axial direction, the inner end Ei is disposed on the inner side of the diffuser outlet 8*a* in the radial direction and on the back side of the middle point Mh in the axial direction, in the separation suppressing cross section 10.

With the above configuration, as shown in FIGS. 5 to 8, it is possible to form the scroll flow passage 4 so that, at the upstream side of the connection position P, the flow line curvature of the fluid that becomes the recirculation flow fc gradually changes toward the connection position P (see the region J in FIG. 6), compared to the comparative example (where the scroll flow passage 004 has a circular cross-sectional shape 010 (FIGS. 3 and 7), through the entire region in the circumferential direction, where the axial directional position of the inner end Ei and the axial directional position of the middle point Mh coincide with each other). Accordingly, it is possible to suppress a rapid change in the flow line curvature of the fluid that becomes the recirculation flow fc in the vicinity of the connection position P, which makes it possible to suppress separation due to the rapid change, and to reduce loss that accompanies recirculation.

In an embodiment, in at least a part of the section 's' (see FIG. 2) of the scroll flow passage 4 from θ=zero degree to a predetermined angular position θ1, as shown in FIG. 3, the flow-passage wall portion w0 connecting the inner end Ei of the separation suppressing cross section 10 and the front end Ef of the scroll flow passage 4 in the axial direction may have a curved surface portion 12 which protrudes toward the cross-sectional center of the scroll flow passage 4.

Accordingly, as shown in FIG. 4, in the separation suppressing cross section 10, it is possible to separate the region Dm through which the main flow fm (see FIG. 6) passes toward the outlet of the scroll flow passage 4 from the region Dc through which the fluid that becomes the recirculation flow fc (see FIG. 6) passes to some extent, with the curved surface portion 8 which protrudes toward the cross-sectional center. Thus, it is possible to guide the main flow fm to the outlet of the scroll flow passage 4 smoothly and to guide the fluid that becomes the recirculation flow fc to the connection position P smoothly, thereby reducing the pressure loss effectively.

In an illustrative embodiment as shown in FIGS. 3 and 4, in the cross section 10 of the scroll flow passage 4, in a case where Lz is a line passing through the middle point Mw of the maximum flow-passage width Wmax of the scroll flow passage 4 in the radial direction and parallel to the axial direction, Lr is a line passing through the middle point Mh and parallel to the radial direction, and D1, D2, D3, D4 are four regions into which the separation suppressing cross section 10 is divided by the line Lz and the line Lr, the flow-passage wall portion w1 belonging to the region D1 positioned on the outer side in the radial direction and on the front side in the axial direction of the intersection C between the line Lz and the line Lr and the flow-passage wall portion w4 belonging to the outer side in the radial direction and on the back side in the axial direction of the intersection C have a constant curvature radius, of the above four regions. Furthermore, the flow-passage wall portion belonging to the inner side in the radial direction and the back side in the axial direction of the intersection C includes a flow-passage wall portion w31 connecting the flow-passage wall portion w4 and the axial directional back end 8*a*1 of the diffuser outlet 8*a* and a flow-passage wall portion w32 connecting the axial directional front end 8*a*2 of the diffuser outlet 8 and the flow-passage wall portion w2 belonging to the inner side in the radial direction and the front side in the axial direction of the intersection C.

In an embodiment, as shown in FIG. 2, provided that the angular position about the scroll center O of the scroll flow passage 4 is zero degree at the connection position P and an angular position upstream of the connection position P in the scroll flow passage 4 is θ, the separation suppressing cross section 10 is disposed at least in the section 's' from θ=zero degree to the predetermined angular position θ1.

As described above, the separation suppressing cross section 10 is disposed from the connection position P in the scroll flow passage 4 to an upstream predetermined angular position θ1, and thereby it is possible to form the scroll flow passage 4 so that the flow line curvature of the fluid that becomes the recirculation flow changes gradually (smoothly) from the angular position θ1 to the connection position P. Accordingly, it is possible to suppress a rapid change in the flow line curvature of the fluid that becomes the recirculation flow in the vicinity of the connection position P, which makes it possible to suppress separation due to the rapid change, and to reduce loss that accompanies recirculation.

In an embodiment, in the scroll flow passage 4 shown in FIG. 2, the separation suppressing cross section 10 may not be necessarily formed in the section 't' upstream of the predetermined angular position θ1 (section upstream of θ1 and extending to the connection position P). The cross-sectional shape at the position separated to some extent upstream of the connection position P has a small effect on separation generation in the vicinity of the connection position P, and the scroll flow passage 4 may have a circular cross section, for instance, in the section 't' upstream of the predetermined angular position θ1. In this case, the predetermined angular position θ1 may be not less than 60 degrees and not more than 150 degrees.

Accordingly, with the separation suppressing cross section 10 applied to the section 's' in the vicinity of the connection position P for separation suppression and a circular cross section or the like applied to the section 't' separated to some extent from the connection position P, it is possible to reduce flow loss in the scroll flow passage 4 while suppressing separation in the vicinity of the connection position P.

Figure 9:
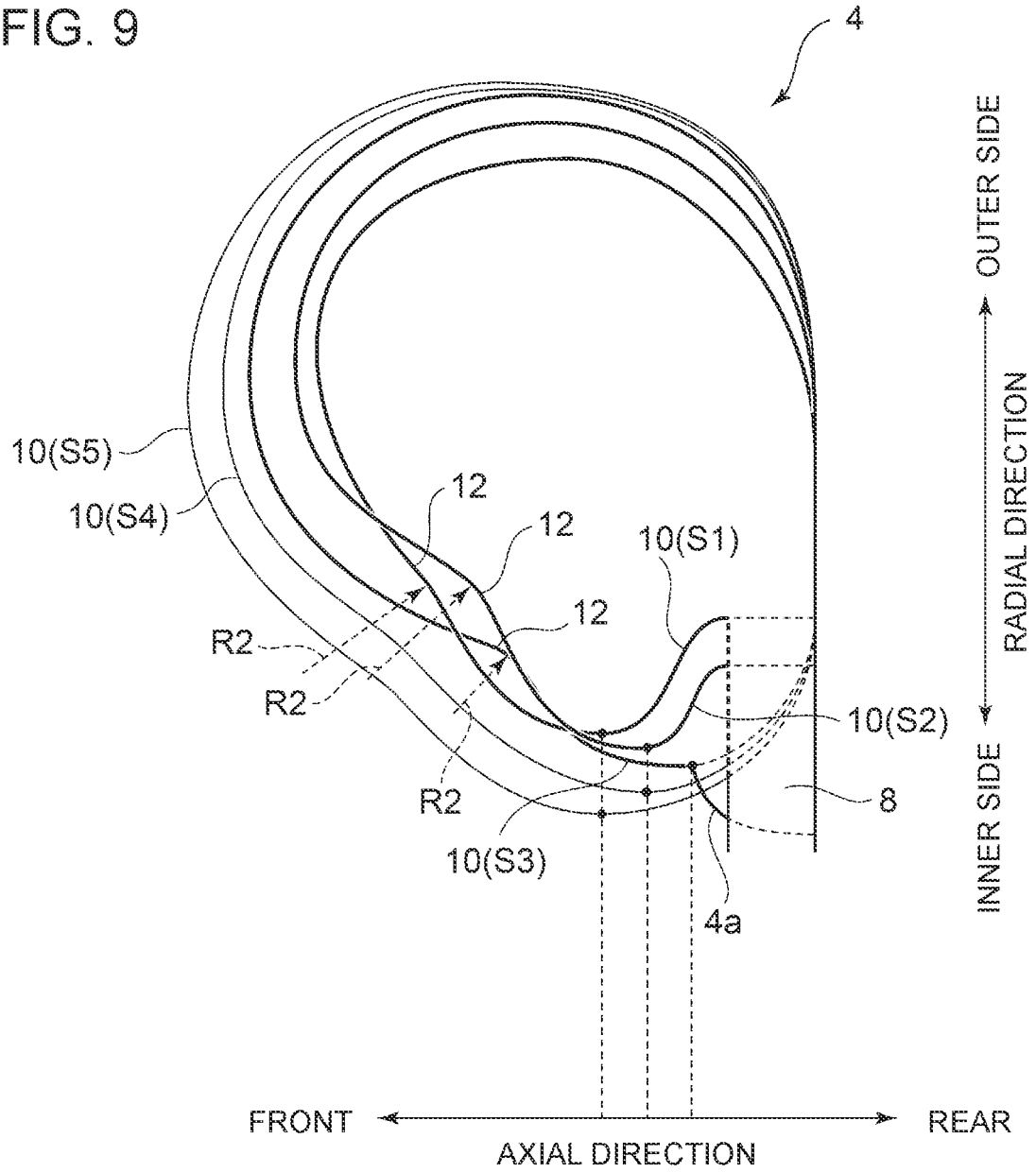
FIG. 9 is a diagram showing the cross-sectional shapes S1 to S5 of the scroll flow passage 4 in FIG. 2.

FIG. 9 is a diagram showing an example of the cross-sectional shapes 10 (S1) to 10 (S5) in the positions S1 to S5 in the scroll flow passage 4 shown in FIG. 2.

In FIG. 9, each dot represents the inner end Ei of corresponding one of the cross-sectional shapes 10 (S1) to 10 (S5). In an embodiment, as shown in FIGS. 2 and 9, in the section 's' of the scroll flow passage 4 from θ=zero degree to the predetermined angular position θ1, the scroll flow passage 4 may be formed so that the inner end Ei is shifted backward in the axial direction from the upstream side toward the connection position P (in the order of 10 (S1), 10 (S2), 10 (S3)).

With the above configuration, as shown in FIGS. 5 to 8, the scroll flow passage 4 is formed so that the flow line curvature of the fluid that becomes the recirculation flow fc gradually changes toward the connection position P (see FIG. 6), compared to the comparative example (where the scroll flow passage has a circular cross-sectional shape through the entire region in the circumferential direction, where the axial directional position of the inner end Ei and the axial directional position of the middle point Mh coincide with each other). Accordingly, it is possible to suppress a rapid change in the flow line curvature of the fluid that becomes the recirculation flow fc in the vicinity of the connection position P, which makes it possible to suppress separation due to the rapid change, and to reduce loss that accompanies recirculation.

In FIG. 9, the magnitude relationship of the curvature radius R2 of the above described curved surface portion 12 in the cross section 10 (S1) to the cross section 10 (S3) is represented by the length of the dotted-line arrows. In an embodiment, as shown in FIG. 9, the curved surface portion 12 may be formed so that the curvature radius R2 decreases from the upstream side toward the connection position P (in the order of 10 (S1), 10 (S2), 10 (S3)) in the scroll flow passage 4.

Figure 6:
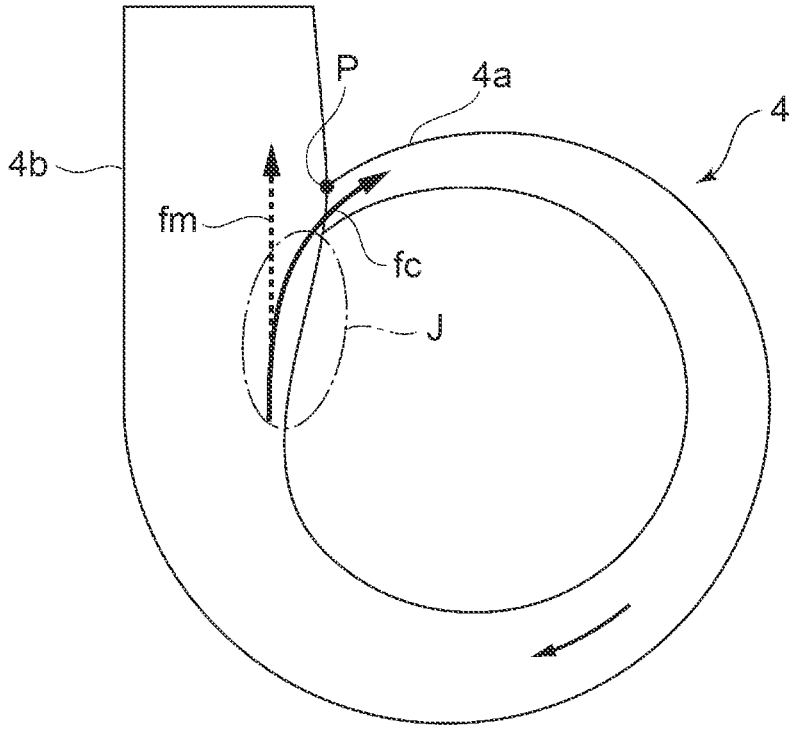
FIG. 6 is a diagram showing the flow line of the recirculation flow fc according to an embodiment.
Figure 7:
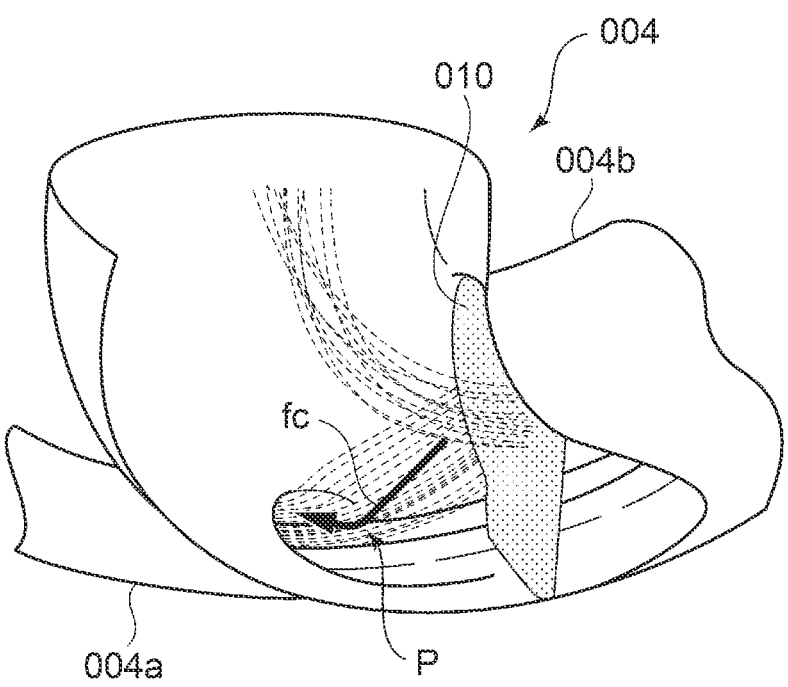
FIG. 7 is a diagram showing the flow line of the recirculation flow fc in the vicinity of the connection position P according to a comparative example (the scroll flow passage has a circular cross-sectional shape, through the entire region in the circumferential direction, where the axial directional position of the inner end Ei and the axial directional position of the middle point Mh coincide with each other).
Figure 8:
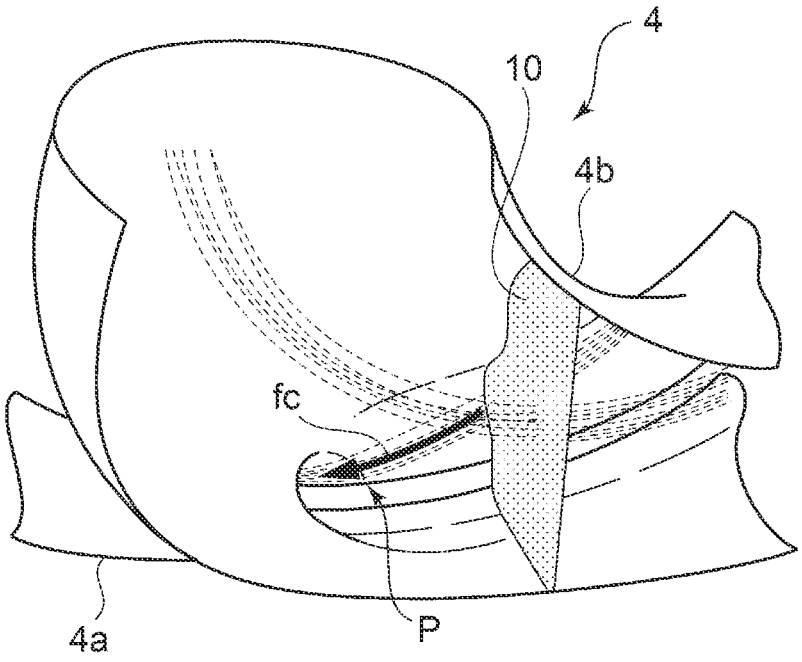
FIG. 8 is a diagram showing the flow line of the recirculation flow fc in the vicinity of the connection position P according to an embodiment.

Accordingly, as shown in FIG. 6, it is possible to gradually separate the recirculation flow fc flowing through the region Dc (see FIG. 4) separated from the main flow fm passing through the region Dm (see FIG. 4) of the separation suppressing cross section 10, and thereby it is possible to enhance the above described effect to guide the main flow fm to the outlet 14 of the scroll flow passage 4 smoothly and to guide the fluid that becomes the recirculation flow fc to the connection position P smoothly, thereby reducing the pressure loss even more effectively.

In an embodiment, at least in a part of the section 's' of the scroll flow passage 4 shown in FIGS. 2 and 3 from θ=zero degree to the predetermined angular position θ1, the distance Δz in the axial direction between the inner end Ei and the middle point Mh and the maximum flow-passage height Hmax may satisfy $\Delta z \geq 0.1 \times Hmax$. Accordingly, it is possible to effectively suppress separation due to a rapid change in the flow line curvature of the fluid that becomes a recirculation flow in the vicinity of the connection position P.

In an embodiment, the scroll flow passage 4 shown in FIGS. 2 and 9 is configured so that the separation suppressing cross section 10 gradually returns to a circular cross section with distance from the connection position P toward the outlet 14 of the scroll flow passage 4 (in the order of 10 (S3), 10 (S4), and 10 (S5)), in the section 'u' disposed at least partially in a region starting from the connection position P, of the section from the connection position P to the outlet 14 of the scroll flow passage 4. That is, the scroll flow passage 4 is formed so that the inner end Ei is shifted forward in the axial direction with distance from the connection position P toward the outlet 14 of the scroll flow passage 4 (in the order of 10 (S3), 10 (S4), and 10 (S5)).

Accordingly, it is possible to suppress occurrence of separation that accompanies recirculation flow in the vicinity of the connection position P while reducing flow loss at a position closer to the outlet 14 than the connection position P.

Figure 10:
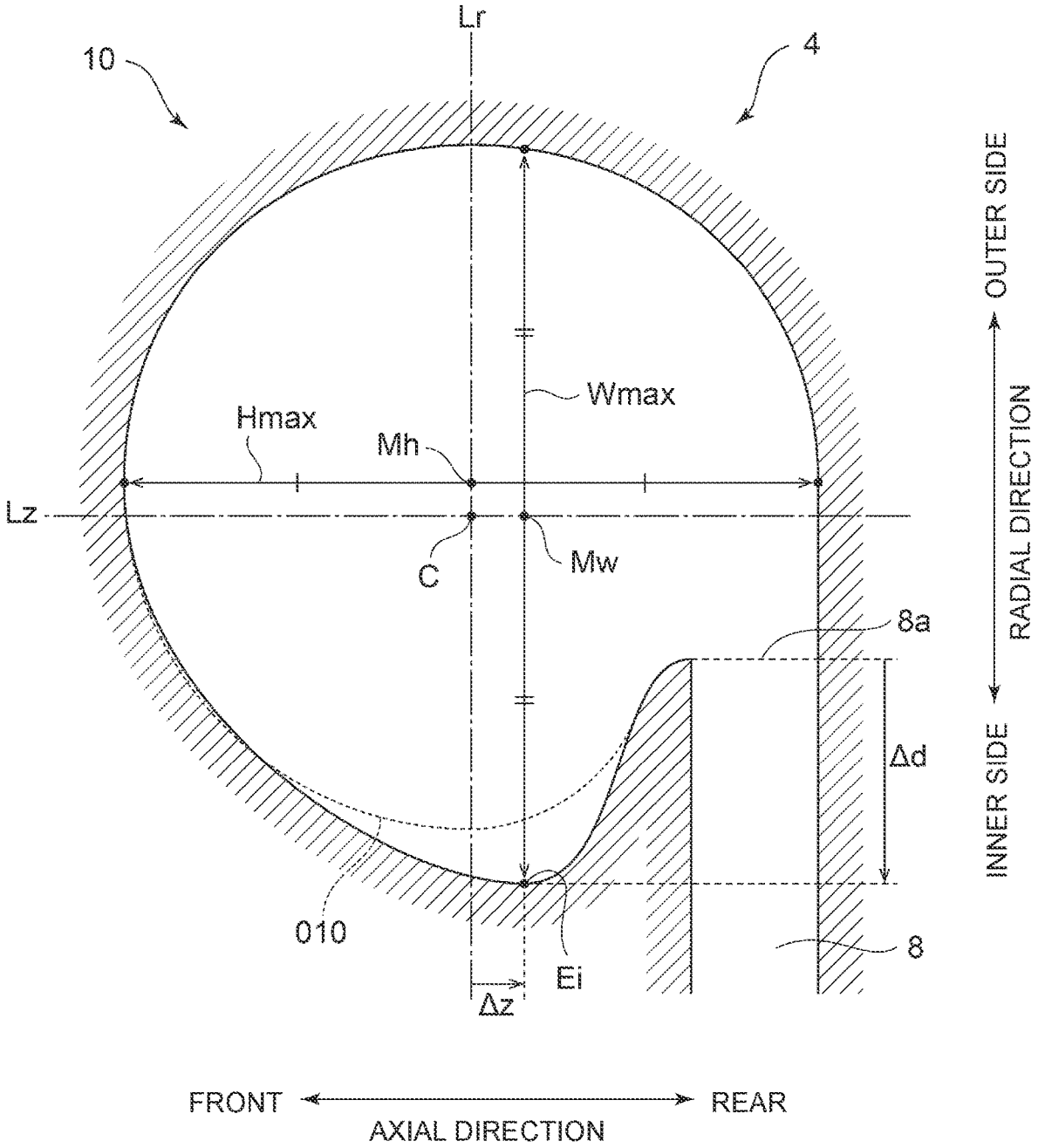
FIG. 10 is a schematic cross-sectional view for describing a shape of a separation suppressing cross section 10 according to an embodiment.
Figure 11:
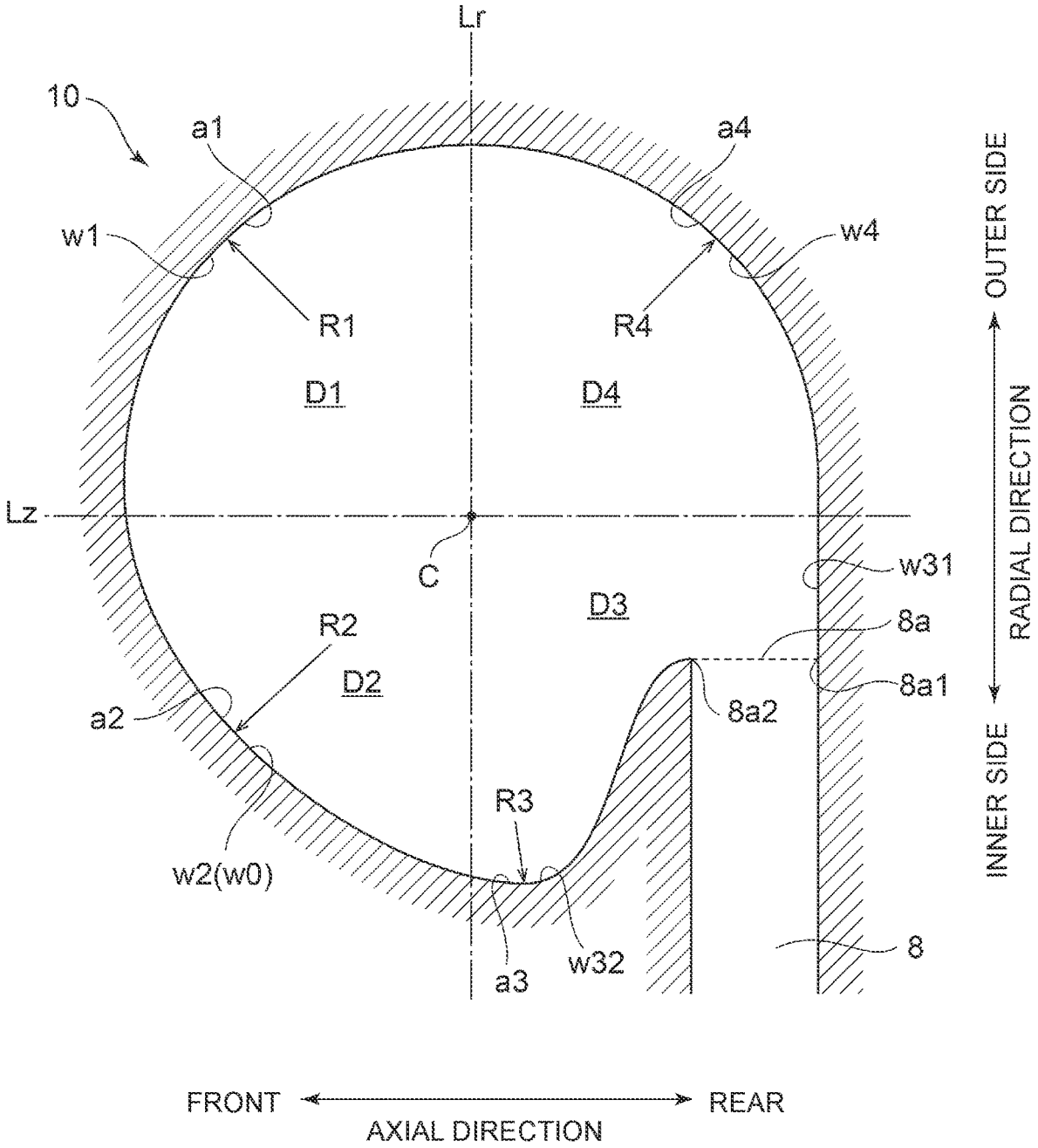
FIG. 11 is a schematic cross-sectional view for describing a shape of a separation suppressing cross section 10 according to an embodiment.
Figure 12:
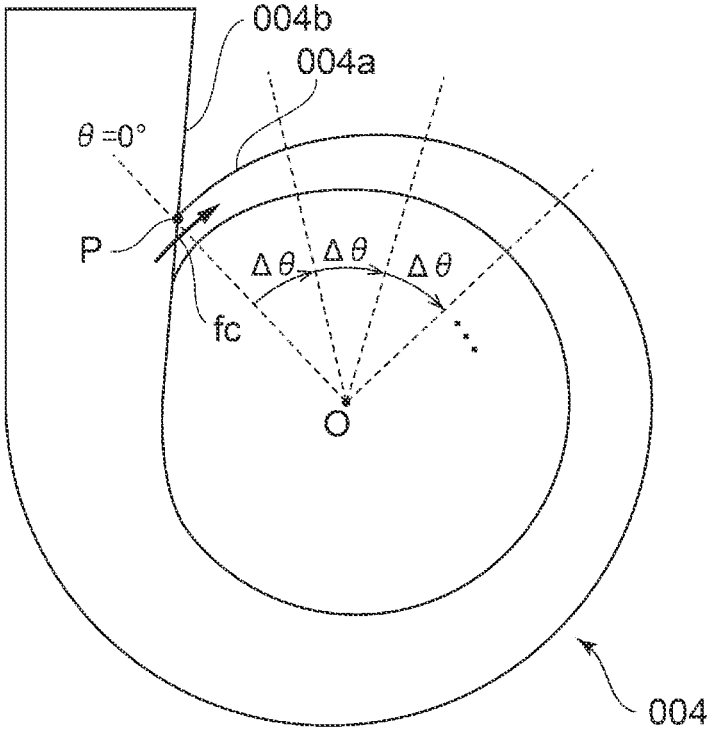
FIG. 12 is a schematic diagram of a scroll flow passage 004 in the axial directional view of the centrifugal compressor according to a comparative example.
Figure 13:
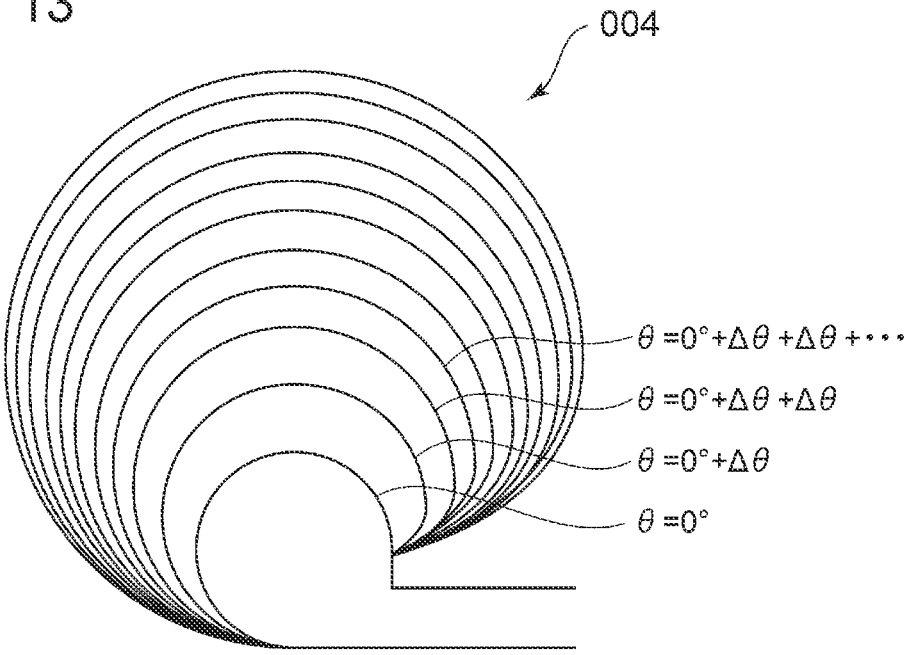
FIG. 13 is a diagram of the scroll flow passage of the centrifugal compressor shown in FIG. 12, showing a cross-sectional shape of the flow passage at each predetermined angle Δθ from the connection position P of a scroll start 004*a* and a scroll end 004*b* toward the downstream side (scroll start side).

While the separation suppressing cross section 10 has the curved surface portion 12 protruding toward the cross-sectional center of the scroll flow passage 4 in the embodiment shown in FIGS. 3, 4, and the like, the separation suppressing cross section 10 may not necessarily have the curved surface portion 12 protruding toward the cross-sectional center of the scroll flow passage 4, as shown in FIGS. 10 and 11.

In this case, as shown in at least one of FIG. 10 or 11, in the cross section 10 of the scroll flow passage 4, in a case where Lz is a line passing through the middle point Mw of the maximum flow-passage width Wmax of the scroll flow passage 4 in the radial direction and parallel to the axial direction, Lr is a line passing through the middle point Mh and parallel to the radial direction, and D1, D2, D3, D4 are four regions into which the separation suppressing cross section 10 is divided by the line Lz and the line Lr, the flow-passage wall portion w1 belonging to the region D1, of the four regions, positioned on the outer side in the radial direction and on the front side in the axial direction of the intersection C of the line Lz and the line Lr includes an arc portion a1 having the first curvature radius R1. Furthermore, the flow-passage wall portion w2 belonging to the region D2 disposed on the inner side in the radial direction and on the front side in the axial direction of the intersection C includes an arc portion a2 having the second curvature radius R2 greater than the first curvature radius R1. Furthermore, of the flow-passage wall portion belonging the region D3 disposed on the inner side in the radial direction and on the back side in the axial direction of the intersection C, the flow-passage wall portion w32 connecting the flow-passage wall portion w2 and the axial directional front end 8*a*2 of the diffuser outlet 8*a* includes an arc portion a3 having the third curvature radius R3 smaller than the second curvature radius R2. The arc portion a3 and the axial directional front end 8a2 of the diffuser outlet 8a are connected smoothly by a curved surface.

Furthermore, in an illustrative embodiment shown in FIGS. 10 and 11, as shown in FIG. 11, the flow-passage wall portion w4 belonging to the region D disposed on the outer side in the radial direction and on the back side in the axial direction of the intersection C includes an arc portion a4 having the curvature radius R4 equal to the first curvature radius R1. Furthermore, the arc portion a4 is connected to an end of the arc portion a1, the other end of the arc portion a1 is connected to an end of the arc portion a2, and the other end of the arc portion a2 is connected to an end of the arc portion a3. Thus, the minimum curvature radius R2min of the flow-passage wall portion w2 belonging to the region D2 (in the exemplary embodiment, R2min equals to R2) is greater than the maximum curvature radius R1max of the flow-passage wall portion belonging to the region D1 (in the exemplary embodiment, R1max equals to R1), and is greater than the maximum curvature radius R4max of the flow-passage wall portion w4 belonging to the region D4. The region D3 includes the flow-passage wall portion w31 connecting the axial directional back end 8a1 and the flow-passage wall portion w4 in the diffuser outlet 8a.

According to the exemplary embodiment shown in FIGS. 10 and 11, when compared to a comparative example (where the scroll flow passage has a circular cross section over the entire region in the circumferential direction), the curvature radius R2 of the arc portion a2 belonging to the region D2 positioned on the inner side in the radial direction and on the front side in the axial direction of the intersection C, of the four regions, is greater than each of the curvature radius R1 and the curvature radius R3 belonging to other regions, and thus it is easier to position the inner end Ei on the back side of the middle point Mh in the axial direction without changing the flow passage cross-sectional area. Thus, it is possible to form the scroll flow passage 4 easily so that the flow line curvature of the fluid that becomes a recirculation flow changes gradually (smoothly) toward the connection position P. Accordingly, it is possible to suppress a rapid change in the flow line curvature of the fluid that becomes the recirculation flow in the vicinity of the connection position P, which makes it possible to suppress separation due to the rapid change, and to reduce loss that accompanies recirculation.

Embodiments of the present invention were described in detail above, but the present invention is not limited thereto, and various amendments and modifications may be implemented.

DESCRIPTION OF REFERENCE NUMERALS

2 Impeller
4 Scroll flow passage
4a Scroll start
4b Scroll end
6 Scroll casing
8 Diffuser flow passage
8a Diffuser outlet
8a1 Front end
8b1 Rear end
10 Separation suppressing cross section
12 Curved surface portion
14 Outlet of scroll flow passage
100 Compressor
100 Centrifugal compressor
C Intersection
D1, D2, D3, D4, Dc, Dm Region
Ei Inner end
Ef Front end
Lr, Lz Line
Mh, Mw Middle point
O Scroll center
P Connection position (tongue section position)
R1 First curvature radius
R2 Second curvature radius
R3 Third curvature radius
R4 Fourth curvature radius
Wmax Maximum flow-passage width
Hmax Maximum flow-passage height
a1, a2, a3, a4 Arc portion
fm Main flow
fc Recirculation flow
s, t, u Section
w0, w1, w2, w31, w32, w4 Flow-passage wall portion

The invention claimed is:

1. A scroll casing which forms a scroll flow passage of a centrifugal compressor, wherein, provided that, in a cross section of the scroll flow passage, Ei is an inner end of the scroll flow passage in a radial direction of the centrifugal compressor, and Mh is a middle point of a maximum flow-passage height Hmax of the scroll flow passage in an axial direction of the centrifugal compressor, the scroll flow passage has a separation suppressing cross section in which the inner end Ei is disposed on an inner side, in the radial direction, of a diffuser outlet, and the inner end Ei is disposed on a back side, in the axial direction, of the middle point Mh, in a section disposed at least partially in an upstream region of a connection position of a scroll start and a scroll end, wherein, provided that an angular position about a scroll center of the scroll flow passage is zero degree at the connection position and the angular position is θ at a position upstream of the connection position, the separation suppressing cross section is disposed at least in a section from θ=zero degree to a predetermined angular position, wherein the separation suppressing cross section is not disposed in a section upstream of the predetermined angular position, wherein the predetermined angular position is an angular position of not less than 60 degrees and not more than 150 degrees.

2. The scroll casing according to claim 1, wherein the scroll flow passage includes a section having a circular cross section at an upstream side of the predetermined angular position.

3. A centrifugal compressor, comprising:

an impeller; and the scroll casing according to claim 1, the scroll casing being disposed around the impeller and forming the scroll flow passage into which a fluid flows after passing through the impeller.

4. A scroll casing which forms a scroll flow passage of a centrifugal compressor, wherein, provided that, in a cross section of the scroll flow passage, Ei is an inner end of the scroll flow passage in a radial direction of the centrifugal compressor, and Mh is a middle point of a maximum flow-passage height Hmax of the scroll flow passage in an axial direction of the centrifugal compressor, the scroll flow passage has a separation suppressing cross section in which the inner end Ei is disposed on an inner side, in the radial direction, of a diffuser outlet, and the inner end Ei is disposed on a back side, in the axial direction, of the middle point Mh, in a section disposed at least partially in an upstream region of a connection position of a scroll start and a scroll end, wherein, provided that an angular position about a scroll center of the scroll flow passage is zero degree at the connection position and the angular position is θ at a position upstream of the connection position, the separation suppressing cross section is disposed at least in a section from θ=zero degree to a predetermined angular position, wherein, at least in a part of the section of the scroll flow passage from θ=zero degree to the predetermined angular position, the inner end Ei of the separation suppressing cross section is shifted backward in the axial direction with a distance from an upstream side toward the connection position.

5. A scroll casing which forms a scroll flow passage of a centrifugal compressor, wherein, provided that, in a cross section of the scroll flow passage, Ei is an inner end of the scroll flow passage in a radial direction of the centrifugal compressor, and Mh is a middle point of a maximum flow-passage height Hmax of the scroll flow passage in an axial direction of the centrifugal compressor, the scroll flow passage has a separation suppressing cross section in which the inner end Ei is disposed on an inner side, in the radial direction, of a diffuser outlet, and the inner end Ei is disposed on a back side, in the axial direction, of the middle point Mh, in a section disposed at least partially in an upstream region of a connection position of a scroll start and a scroll end, wherein, provided that an angular position about a scroll center of the scroll flow passage is zero degree at the connection position and the angular position is θ at a position upstream of the connection position, the separation suppressing cross section is disposed at least in a section from θ=zero degree to a predetermined angular position, wherein, at least in a part of the section of the scroll flow passage from θ=zero degree to the predetermined angular position, a flow-passage wall portion connecting the inner end Ei and a front end Ef of the scroll flow passage with respect to the axial direction has a curved surface portion which protrudes toward a cross-sectional center of the separation suppressing surface.

6. The scroll casing according to claim 5, wherein the curved surface portion is formed so as to have a curvature radius which decreases from an upstream side of the scroll flow passage toward the connection position.

7. A scroll casing which forms a scroll flow passage of a centrifugal compressor, wherein, provided that, in a cross section of the scroll flow passage, Ei is an inner end of the scroll flow passage in a radial direction of the centrifugal compressor, and Mh is a middle point of a maximum flow-passage height Hmax of the scroll flow passage in an axial direction of the centrifugal compressor, the scroll flow passage has a separation suppressing cross section in which the inner end Ei is disposed on an inner side, in the radial direction, of a diffuser outlet, and the inner end Ei is disposed on a back side, in the axial direction, of the middle point Mh, in a section disposed at least partially in an upstream region of a connection position of a scroll start and a scroll end, wherein, in the cross section of the scroll flow passage, in a case where Lz is a line passing through a middle point Mw of a maximum flow-passage width Wmax of the scroll flow passage in the radial direction and parallel to the axial direction, Lr is a line passing through the middle point Mh and parallel to the radial direction, and the separation suppressing cross section is divided into four regions by the line Lz and the line Lr, a flow-passage wall portion belonging to a region positioned on an outer side in the radial direction and on a front side in the axial direction of an intersection C of the line Lz and the line Lr, of the four regions, includes an arc portion having a first curvature radius R1, a flow-passage wall portion belonging to a region positioned on an inner side in the radial direction and on a front side in the axial direction of the intersection C, of the four regions, includes an arc portion having a second curvature radius R2 which is greater than the first curvature radius R1, and a flow-passage wall portion belonging to a region positioned on an inner side in the radial direction and on a back side in the axial direction of the intersection C, of the four regions, includes an arc portion having a third curvature radius R3 which is smaller than the second curvature radius R2.

8. A scroll casing which forms a scroll flow passage of a centrifugal compressor, wherein, provided that, in a cross section of the scroll flow passage, Ei is an inner end of the scroll flow passage in a radial direction of the centrifugal compressor, and Mh is a middle point of a maximum flow-passage height Hmax of the scroll flow passage in an axial direction of the centrifugal compressor, the scroll flow passage has a separation suppressing cross section in which the inner end Ei is disposed on an inner side, in the radial direction, of a diffuser outlet, and the inner end Ei is disposed on a back side, in the axial direction, of the middle point Mh, in a section disposed at least partially in an upstream region of a connection position of a scroll start and a scroll end, wherein, provided that an angular position about a scroll center of the scroll flow passage is zero degree at the connection position and the angular position is θ at a position upstream of the connection position, the separation suppressing cross section is disposed at least in a section from θ=zero degree to a predetermined angular position, wherein, at least in a part of the section of the scroll flow passage from θ=zero degree to the predetermined angular position, the maximum flow-passage height Hmax and a distance Δz between the inner end Ei of the separation suppressing cross section and the middle point Mh in the axial direction satisfies $\Delta z \geq 0.1 \times Hmax$.

9. A scroll casing which forms a scroll flow passage of a centrifugal compressor, wherein, provided that, in a cross section of the scroll flow passage, Ei is an inner end of the scroll flow passage in a radial direction of the centrifugal compressor, and Mh is a middle point of a maximum flow-passage height Hmax of the scroll flow passage in an axial direction of the centrifugal compressor, the scroll flow passage has a separation suppressing cross section in which the inner end Ei is disposed on an inner side, in the radial direction, of a diffuser outlet, and the inner end Ei is disposed on a back side, in the axial direction, of the middle point Mh, in a section disposed at least partially in an upstream region of a connection position of a scroll start and a scroll end, wherein, provided that an angular position about a scroll center of the scroll flow passage is zero degree at the connection position and the angular position is θ at a position upstream of the connection position, the separation suppressing cross section is disposed at least in a section from θ=zero degree to a predetermined angular position, wherein the scroll flow passage is formed so that the inner end Ei is shifted forward in the axial direction with a distance from the connection position toward an outlet of the scroll flow passage, and wherein, at least in a part of the section of the scroll flow passage from the connection position toward the outlet of the scroll flow passage, a flow-passage wall portion connecting the inner end Ei and a front end Ef of the scroll flow passage with respect to the axial direction has a curved surface portion which protrudes toward a cross-sectional center of the separation suppressing surface.

* * * * *